US008631776B2

(12) United States Patent
Dietel et al.

(10) Patent No.: US 8,631,776 B2
(45) Date of Patent: Jan. 21, 2014

(54) ASSEMBLED CAMSHAFT

(75) Inventors: Uwe Dietel, Reinsdorf (DE); Uwe Grossgebauer, Dresden (DE); Jonathan Heywood, Pettstadt (DE); Bernd Mann, Zschopau (DE)

(73) Assignee: ThyssenKrupp Presta TecCenter AG, Eschen (LI)

( * ) Notice: Subject to any disclaimer, the term of this patent is extended or adjusted under 35 U.S.C. 154(b) by 283 days.

(21) Appl. No.: 13/157,614

(22) Filed: Jun. 10, 2011

(65) Prior Publication Data

US 2011/0303173 A1 Dec. 15, 2011

(30) Foreign Application Priority Data

Jun. 12, 2010 (DE) ..... 10 2010 023 571

(51) Int. Cl.
*F01L 1/04* (2006.01)

(52) U.S. Cl.
USPC ..... 123/90.6; 123/90.16; 123/90.44; 29/888.1

(58) Field of Classification Search
USPC ..... 123/90.6, 90.16, 90.44; 29/888.1
See application file for complete search history.

(56) References Cited

FOREIGN PATENT DOCUMENTS

| | | | |
|---|---|---|---|
| DE | 42 40 631 | A1 | 6/1994 |
| DE | 4403426 | A1 * | 8/1994 |
| EP | 582846 | A1 * | 2/1994 |
| EP | 1 500 797 | A1 | 1/2005 |

* cited by examiner

*Primary Examiner* — Ching Chang
(74) *Attorney, Agent, or Firm* — Crowell & Moring LLP

(57) ABSTRACT

An assembled camshaft includes an outer hollow camshaft body and an inner camshaft body disposed within the outer hollow camshaft body and mounted so as to rotate relative to it by a predetermined angle. The camshaft also includes at least two separate cam elements. A first cam element is connected with the inner camshaft body so as to rotate with it, and is disposed so as to rotate relative to the outer hollow camshaft body. A second cam element has at least two partial cam elements, in such a manner that a first partial cam element is disposed on the outer hollow camshaft body, so as to rotate with it, and a second partial cam element is connected with the inner camshaft body, so as to rotate with it, and is disposed so that it can be rotated relative to the outer hollow camshaft body.

9 Claims, 4 Drawing Sheets

ASSEMBLED CAMSHAFT

CROSS REFERENCE TO RELATED APPLICATION

The present application claims priority under 35 U.S.C. §119 to German Patent Application No. 10 2010 023 571.7-13, filed Jun. 12, 2010, the entire disclosure of which aforementioned document is herein expressly incorporated by reference

BACKGROUND AND SUMMARY OF THE INVENTION

The present invention relates to an assembled camshaft for an internal combustion engine, having an outer hollow camshaft body and an inner camshaft body disposed within the outer hollow camshaft body and mounted so as to rotate relative to it by a predetermined angle. In this connection, the camshaft has at least two different cam elements that can also be rotated relative to one another, at least in parts, by way of the camshaft bodies that can be rotated relative to one another.

During operation of internal combustion engines, it is desirable to be able to variably configure the opening and closing of the inlet and outlet gas exchange valves. In this manner, corresponding control of the gas exchange valves can be controlled in targeted manner, as a function of the operating state of the internal combustion engine, in order to achieve optimal behavior of the gas exchange valves.

A reciprocating internal combustion engine is disclosed in German patent document DE 42 40 631 A1, having at least two gas exchange valves per cylinder, where the cam elements that belong to or are assigned to the gas exchange valves, in each instance, are situated on camshafts that are disposed concentric to one another. By means of the concentrically disposed camshafts and the different cam elements, which are connected with different camshafts so as to rotate with them, accordingly, corresponding control of the cam elements relative to one another and a corresponding behavior of the internal combustion engine can be achieved by rotation of the camshafts relative to one another. In addition to this relative rotation of individual cam elements relative to one another, rotation of the entire camshaft—in other words of the two camshaft bodies disposed concentric to one another, together, in relation to the angle position of the crankshaft—is possible. In this way, further optimization of the gas exchange valve control with regard to the desired fuel reduction and/or power increase of the internal combustion engine can be achieved. A disadvantage of such an arrangement is the relatively complicated mechanical design for adjusting the inner camshaft relative to the outer camshaft, or for adjusting the overall camshaft in relation to the crankshaft. Further disadvantages of such designs are the required greater construction space as well as the costs, which are comparatively higher.

Furthermore, a camshaft having so-called expanding cams is known from European patent document EP 1 500 797 A1, in which shaft at least two partial cams of a cam element that can be rotated relative to one another is achieved by rotation of an inner camshaft body situated concentrically in the interior of an outer camshaft body, relative to the outer camshaft body. By means of the proposed configuration of cam elements as so-called expansion cams, the opening period of the valves, i.e. the time point of opening and/or closing of the gas exchange valves, as well as the duration of the valve overlap can be influenced at a constant stroke. If a long valve opening period is desired, the partial cams are brought into a position, relative to one another, in which the profile regions with constant stroke lie next to one another, seen in the axial direction of the camshaft (cam element expanded by means of rotation of the partial cams). In this way, the effect of a broad or steeper cam, i.e. one expanded in the circumference direction, can be achieved. Broadening of the cam element can furthermore lead to a greater overlap of the inlet and outlet valve. If, in contrast, a shorter opening period is desired, the partial cams are brought into a position, relative to one another, in which the profile regions with constant stroke are disposed essentially one behind the other, seen in the axial direction of the camshaft (cam element not expanded). In this way, the effect of a narrower cam/cam element, i.e. one strictly limited in the circumference direction, can be achieved.

An increase in the variability of the valve control is only possible by means of the additional adjustment of the entire camshaft relative to the crankshaft, using a second camshaft adjuster. This increases the costs, on the one hand, and worsens the installation situation with regard to utilization of the available construction space, on the other hand.

The present invention provides an assembled camshaft by means of which the most variable possible control of the gas exchange vales of an internal combustion engine is made possible, on the one hand, and in which the least possible effort with regard to adjustment of the cam elements relative to one another is implemented, on the other hand. The production costs are advantageously reduced, in comparison with conventional systems, by means of the simplest possible design structure, and the required construction space is supposed to be minimized.

According to the invention, this is accomplished in that the assembled camshaft comprises at least two separate cam elements, where a first cam element is connected with the inner camshaft body, in its totality, so as to rotate with it, and is disposed so as to rotate relative to the outer camshaft body, which is configured as a hollow camshaft body, and that a second cam element has at least two partial cam elements that can be rotated relative to one another, in such a manner that a first partial cam element is disposed on the outer hollow camshaft body, so as to rotate with it, and a second partial cam element is connected with the inner camshaft body, so as to rotate with it, and is disposed so that it can be rotated relative to the outer hollow camshaft body.

In a particularly preferred embodiment of the invention, the at least two different cam elements are disposed on the camshaft, axially spaced apart from one another, in such a manner that inlet-side or outlet-side control of at least a first gas exchange valve of a cylinder combustion chamber of the internal combustion engine is made possible by the at least one first cam element, and inlet-side or outlet-side control of at least a second gas exchange valve of the same cylinder combustion chamber is made possible by means of the at least one second cam element (in analogy to the first cam element). Thus, two inlet-side or two outlet-side gas exchange valves of a common cylinder combustion chamber are advantageously always activated by means of two different cam elements of the first and second construction type (and connection to the camshaft), disposed axially adjacent on the same camshaft (first cam element and second cam element), or stand in interaction with them, respectively.

In other embodiments, the at least one first cam element is assigned to the at least one gas exchange valve of a first cylinder combustion chamber, and the at least one second cam element is assigned to the at least one gas exchange valve of another cylinder combustion chamber.

In each case, the corresponding assignment is possible both on the inlet side and on the outlet side. Of course, the configuration of the camshaft according to the invention, which is implemented by means of the configuration of the different first and second cam elements or their placement on the hollow camshaft body or the inner camshaft body, can be expanded to include additional cam elements such as, for example, at least one cam element of a third type (also referred to as a third cam element). For example, the third cam element can be disposed, in its totality, on the outer hollow camshaft body, so as to rotate with it.

For relative rotation of the two camshaft bodies with regard to one another, a drive device is provided, which, in a first embodiment, acts on the outer hollow camshaft body and/or the inner camshaft body rotationally, or which, in another embodiment, acts on the inner camshaft body, particularly translationally, and thereby brings about a corresponding relative rotation with regard to the outer hollow camshaft body. Finally, a second drive device can be provided, for rotation of the entire camshaft relative to the position of the crankshaft of the internal combustion engine.

In another preferred further development of the invention, the at least one cam element of the second type (cam element having at least two partial cam elements that can be rotated relative to one another) is configured in such a manner that the two partial cam elements have a different maximal stroke height and the cam peak section of the partial cam having the lesser maximal stroke height has a cam contour section having a maximal stroke height formed by an arc section. With regard to the function and design configuration of the cam element configured in multiple parts, at this point the disclosure content of the German patent application having the official file number 10 2009 041 426.6, which is not a prior publication, is explicitly incorporated into the disclosure content of the present application. Alternatively or additionally, a cam element of the third type can also be structured by means of a cam element configured in multiple parts, according to German patent document DE 10 2009 041 426.6, or be present, respectively.

The invention furthermore relates to an internal combustion engine having such an assembled camshaft, where with regard to at least one cylinder of the internal combustion engine, at least a first cam element and a second cam element interact with a gas exchange valve of one and the same cylinder combustion chamber, on the inlet or outlet side.

Further characteristics, properties, and advantages of the present invention are evident from the following figure description of a preferred exemplary embodiment of the invention, making reference to the attached drawing figures.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1A:
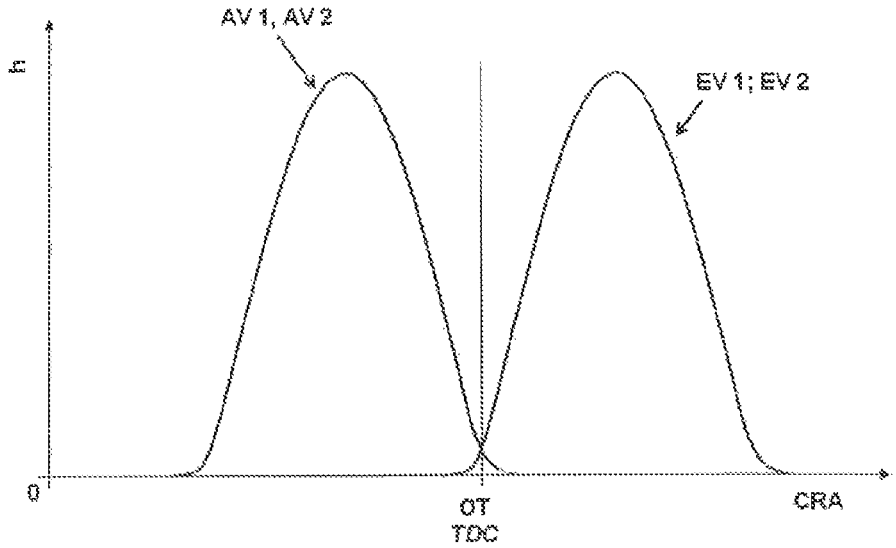
FIGS. 1*a*, 1*b* illustrate the valve stroke progression of a gas exchange valve of an internal combustion engine above the crankshaft angle in the case of control with a camshaft according to the state of the art described initially.
Figure 1B:
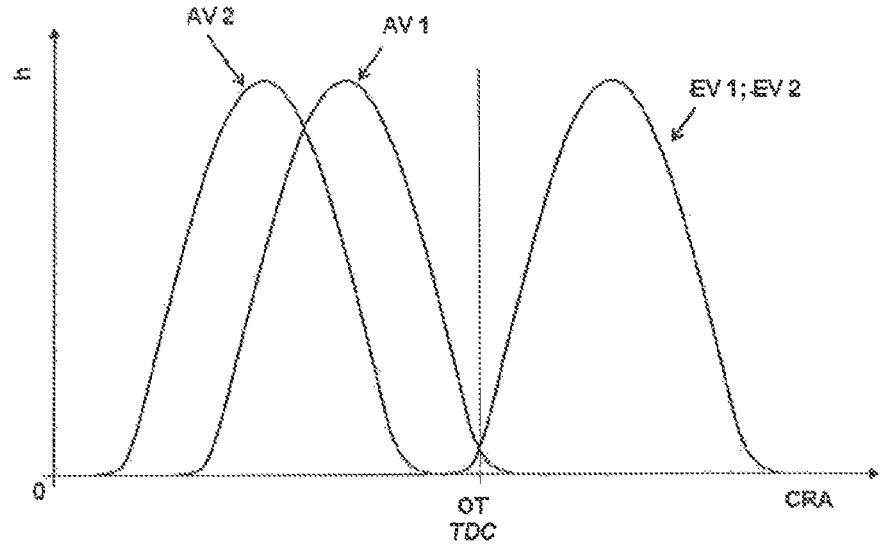

In the valve stroke diagram (valve stroke h above crankshaft angle CRA) according to FIG. 1*a*, the valve stroke progressions (AV1, AV2; EV1, EV2) of two outlet valves (left curve(s)) and two inlet valves (right curve(s)) are shown, with the camshaft bodies NW1, NW2 or cam elements (NE1, NE2) not rotated relative to one another, so that a valve stroke progression (AV1, AV2) of the outlet side gas exchange valves suitable for full-load operation occurs, for example. If the gas exchange valves are now controlled with a camshaft according to the state of the art (DE 42 40 631 A1), where at least the outlet-side gas exchange valves are now controlled in changed manner, by means of the relative rotation of the two cam elements that control the two outlet valves, a valve stroke progression according to FIG. 1*b* (such as it could be provided for partial-load operation, for example) occurs when the camshaft bodies are rotated (rotation of the inner camshaft body relative to the concentric outer hollow camshaft body). According to the valve stroke progression of FIG. 1*b*, a first outlet gas exchange valve maintains its valve stroke curve (AV1) with regard to stroke and phase, while the second outlet valve assumes a phase shift relative to the first valve stroke progression (see valve stroke progression AV2 with reference to the crankshaft angle CRA plotted on the abscissa side), because of the relative rotation of the two cam elements with regard to one another. In the exemplary embodiment shown, the two inlet valves are controlled by way of unchangeable, fixed cam elements, so that no additional phase shift of the two valve stroke progressions relative to one another is evident or occurs.

Figure 2A:
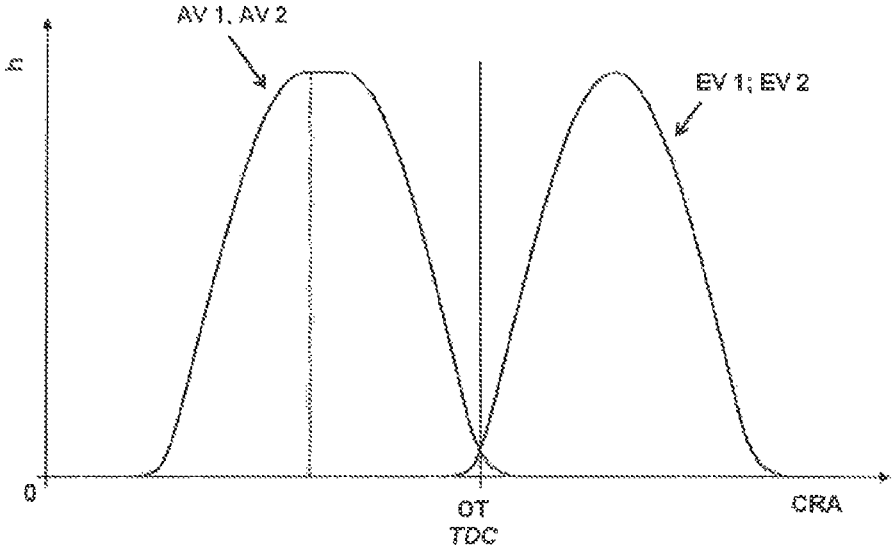
FIGS. 2*a*, 2*b* illustrate the valve stroke progression of a gas exchange valve above the crankshaft angle in the case of control with a camshaft according to the state of the art described initially (expansion cam)
Figure 2B:
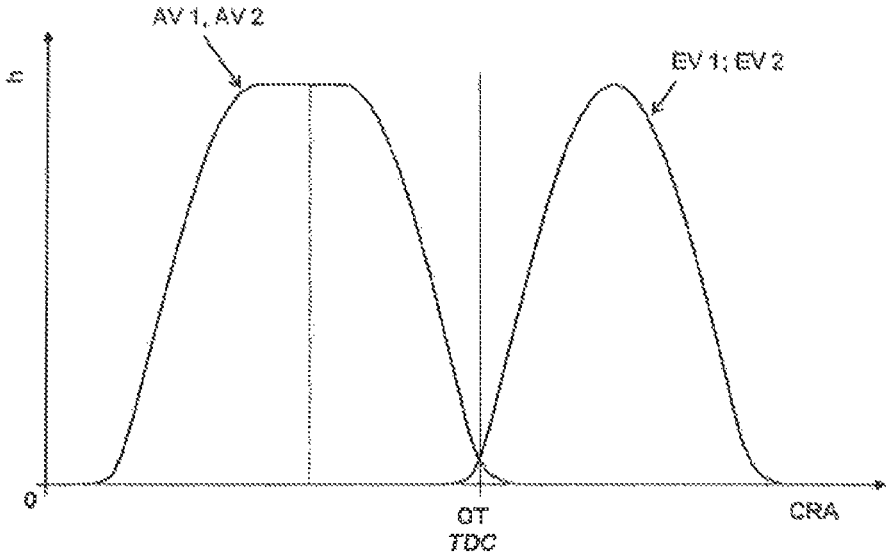

The valve stroke progression (AV1, AV2) of two outlet-side gas exchange valves (left stroke curve(s)) and the valve stroke progression (EV1, EV2) of two inlet valves (right curve(s)) is shown according to FIG. 2*a*. Control of two outlet-side gas exchange valves and two inlet-side gas exchange valves of a common cylinder combustion chamber of an internal combustion engine is shown (in analogy to the representations in FIGS. 1 and 3). If the gas exchange valves are now controlled by way of a camshaft according to the other state of the art described initially (EP 1 500 797 A1), where at least the two outlet-side gas exchange valves are controlled by way of such an expansion cam, and this expansion cam is expanded accordingly, by means of relative rotation of inner shaft with regard to outer shaft, the valve stroke progression according to FIG. 2*b* occurs.

Figure 3A:
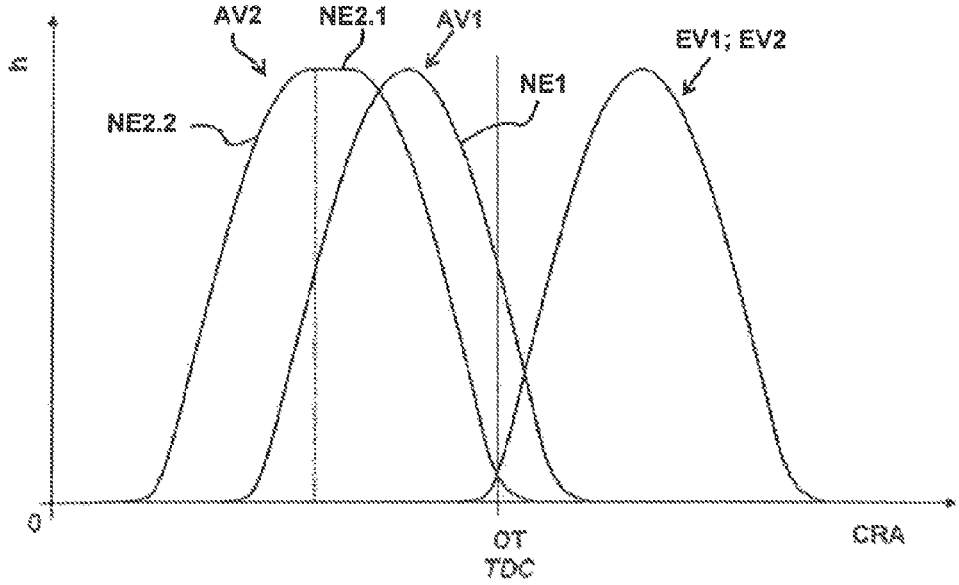
FIGS. 3*a*, 3*b* illustrate the valve stroke progression of a gas exchange valve above the crankshaft angle, which valve was controlled with a camshaft according to the invention.
Figure 3B:
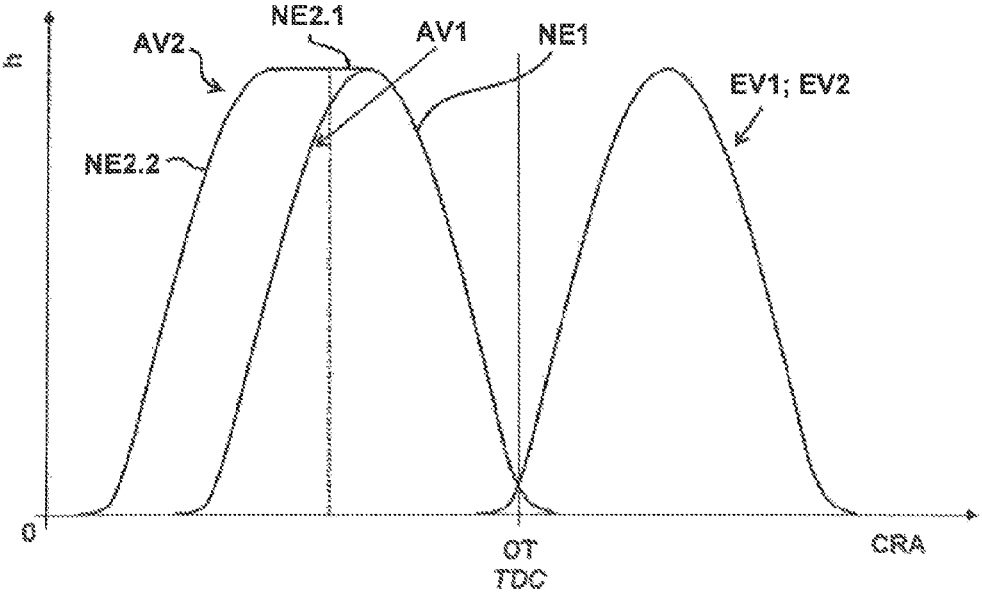
Figure 3C:
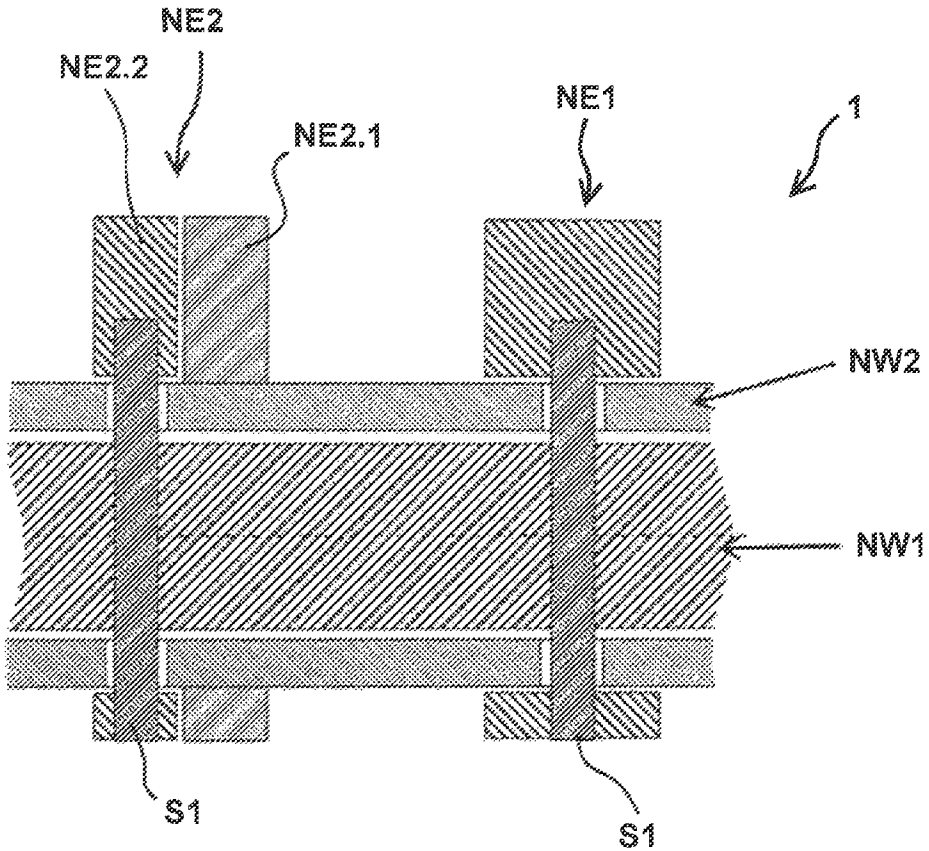
FIG. 3*c* illustrates the design of a camshaft according to the invention, in a detail-type sectional representation, in a possible embodiment.

According to FIG. 3*c*, details of the design structure of a camshaft according to the invention, in a possible embodiment, are shown in a sectional representation. Specifically, FIG. 3*c* illustrates two cam elements NE1 and NE2 disposed on a concentrically structured camshaft 1, for control of two gas exchange valves (not shown) of an internal combustion engine. In a preferred embodiment, the two cam elements NE1, NE2 are disposed on the camshaft 1, relative to one another, in such a manner that control of inlet-side or outlet-side gas exchange valves of a common cylinder combustion chamber takes place by way of the cam elements. In this connection, the first cam element NE1 is configured as an undivided, one-part cam, and disposed so as to rotate with the inner camshaft body NW1 and so that it can rotate relative to the outer hollow camshaft body NW2. For this purpose, the first cam element NE1 is connected with the inner camshaft body NW1, so as to rotate with it, by way of a pin 51, where the pin 51 runs through a slit opening in the hollow camshaft body NW2 that runs over part of the circumference. The opening corresponds at least to the adjustment angle between inner and outer camshaft body NW1, NW2.

The second cam element NE2, which is axially spaced apart and disposed adjacent, is advantageously configured in two parts in the exemplary embodiment shown, where a first partial cam element NE2.1 is connected on the outer camshaft body (hollow camshaft body) NW2, so as to rotate with it (and, particularly, also so that it cannot be displaced), and a second partial cam element NE2.2 is connected with the inner camshaft body NW1 so as to rotate with it, by way of a pin connection (analogous to the connection of the first cam element NE1 with the inner camshaft body NW1). If control or activation of outlet-side gas exchange valves of a common cylinder combustion chamber now takes place by means of the camshaft 1 configured according to the invention, a valve stroke progression (AV1, AV2) according to FIGS. 3*a* and 3*b* occurs.

In this connection, in FIG. 3*a*, the valve stroke progression (AV1, AV2) is shown above the crankshaft angle CRA, for the case that the two camshaft bodies NW1 and NW2 are not rotated relative to one another, or are set in a defined basic position. If the two camshaft bodies NW1 and NW2 are rotated relative to one another, by way of a drive device, not shown, and thus the cam elements NE1 and NE2 (or NE2.1) are rotated relative to one another, a valve stroke progression (AV1, AV2) according to FIG. 3*b* occurs. By means of the configuration of the camshaft 1 according to the invention, in which a first cam element NE1, in its totality, is connected with the inner camshaft body NW1, so as to rotate with it, and, analogous to this, a partial cam element NE2.2 of the second cam element NE2 is connected with the inner camshaft body NW1 in the same manner, or also so as to rotate with it, and another partial cam element NE2.1 is disposed on the outer hollow camshaft element NW2, so as to rotate with it, a valve stroke progression (AV1, AV2) according to FIG. 3*b* can be achieved. In this way, a phase shift between the two gas exchange valves controlled by way of the design according to the invention can be achieved and a corresponding lengthening of the maximal cam stroke is achieved by way of the expansion (of the two partial cam elements NE2.1 and NE2.2) of the second cam element NE2 configured as an expansion cam that takes place. In the exemplary embodiment shown, a step-free transition in the region of the maximal valve stroke is achieved by means of the camshaft design or cam element configuration according to the invention, and its placement on the camshaft bodies, in each instance.

Of course, any desired combination of fixed cams (cams that are disposed in fixed (non-rotatable and non-displaceable) manner on the outer hollow camshaft body), adjustable cams (analogous to the cam element NE1), and expansion cams (analogous to the cam element NE2) on the inlet and/or outlet camshaft of a DOHC engine, an SOHC engine, or an OHV engine is possible within the scope of the invention.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An assembled camshaft for an internal combustion engine, comprising:

an outer hollow camshaft body;

an inner camshaft body disposed within the outer hollow camshaft body and mounted so as to rotate relative to the outer hollow camshaft body by a predetermined angle;

first and second cam elements, the first and second cam elements are separate cam elements, wherein the first cam element is connected with the inner camshaft body, in its totality, so as to rotate with the inner camshaft body, and is disposed so as to rotate relative to the hollow outer camshaft body, and wherein the second cam element has at least a first and second partial cam elements, the first partial cam element is disposed on the outer hollow camshaft body so as to rotate with the outer hollow camshaft body, and the second partial cam element is connected with the inner camshaft body so as to rotate with the inner camshaft body, and is disposed so that it can be rotated relative to the outer hollow camshaft body by relative rotation of the outer and inner camshaft bodies.

2. The assembled camshaft according to claim 1, wherein at least the first cam element and at least the second cam element are disposed on the assembled camshaft, axially spaced apart from one another, in a manner that inlet-side or outlet-side control of at least a first gas exchange valve of a cylinder combustion chamber of the internal combustion engine is achieved by at least the first cam element, and inlet-side or outlet-side control of at least a second gas exchange valve of the same cylinder combustion chamber is achieved by at least the second cam element.

3. The assembled camshaft according to claim 1, wherein at least the first cam element and at least the second cam element are disposed on the assembled camshaft, axially spaced apart from one another, in a manner that inlet-side or outlet-side control of at least one gas exchange valve of a first cylinder combustion chamber of the internal combustion engine is achieved by at least the one first cam element, and inlet-side or outlet-side control of at least one gas exchange valve of a second cylinder combustion chamber is achieved by at least the second cam element.

4. The assembled camshaft according to claim 1, further comprising:

a drive device for relative rotation between the outer hollow camshaft body and the inner camshaft body, where the drive device is configured in a manner that the relative rotation of the outer and inner camshaft bodies is achieved by a drive movement having a rotational effect, on the outer hollow camshaft body or the inner camshaft body.

5. The assembled camshaft according to claim 1, further comprising:

a first drive device for relative rotation between the outer hollow camshaft body and the inner camshaft body, where the first drive device is configured in a manner that the relative rotation of the outer and inner camshaft bodies is achieved by a drive movement having a translational effect, on the inner camshaft body.

6. The assembled camshaft according to claim 5, further comprising:

a second drive device for rotating the assembled camshaft, in its totality, relative to a position of a crankshaft of the internal combustion engine.

7. The assembled camshaft according to claim 1, further comprising:

at least one additional, third cam element, which, in its totality, is connected with the outer hollow camshaft body, so as to rotate with the outer hollow camshaft body.

8. An internal combustion engine comprising:

an assembled camshaft, which includes an outer hollow camshaft body;

an inner camshaft body disposed within the outer hollow camshaft body and mounted so as to rotate relative to the outer hollow camshaft body by a predetermined angle;

first and second cam elements, the first and second cam elements are separate cam elements, wherein the first cam element is connected with the inner camshaft body, in its totality, so as to rotate with the inner camshaft body, and is disposed so as to rotate relative to the hollow outer camshaft body, and wherein the second cam element has at least a first and second partial cam elements, the first partial cam element is disposed on the outer hollow camshaft body so as to rotate with the outer hollow camshaft body, and the second partial cam element is connected with the inner camshaft body so as to rotate with the inner camshaft body, and is disposed so that it can be rotated relative to the outer hollow camshaft body by relative rotation of the outer and inner camshaft bodies.

9. An internal combustion engine according to claim 8, wherein with regard to at least one cylinder of the internal combustion engine, at least the first cam element and the second cam element interact with a gas exchange valve of a same cylinder combustion chamber of the internal combustion engine, on an inlet or outlet side.

* * * * *